US007033581B2

(12) United States Patent
Pyles

(10) Patent No.: US 7,033,581 B2
(45) Date of Patent: Apr. 25, 2006

(54) METHOD OF TREATING HAIR WITH HEAT AND A CAP WHICH PROVIDES A SIGNAL REGARDING TREATMENT

(75) Inventor: Daniel Raymond Pyles, Algonquin, IL (US)

(73) Assignee: Unilever Home & Personal Care USA division of Conopco, Inc., Chicago, IL (US)

( * ) Notice: Subject to any disclaimer, the term of this patent is extended or adjusted under 35 U.S.C. 154(b) by 122 days.

(21) Appl. No.: 10/616,729

(22) Filed: Jul. 10, 2003

(65) Prior Publication Data

US 2005/0074639 A1 Apr. 7, 2005

Related U.S. Application Data

(62) Division of application No. 09/952,061, filed on Sep. 14, 2001, now abandoned.

(51) Int. Cl.
*A61K 7/06* (2006.01)

(52) U.S. Cl. ..... 424/70.1; 424/70.11; 424/70.6

(58) Field of Classification Search ..... 424/70.1, 424/70.6, 70.11

See application file for complete search history.

(56) References Cited

U.S. PATENT DOCUMENTS

| | | | | |
|---|---|---|---|---|
| 4,028,118 | A | 6/1977 | Nakasuji et al. | |
| 4,421,560 | A * | 12/1983 | Kito et al. | 106/31.2 |
| 4,421,561 | A | 12/1983 | Brixius | |
| 4,725,462 | A | 2/1988 | Kimura | |
| 4,891,227 | A | 1/1990 | Thaman et al. | |
| 4,891,228 | A | 1/1990 | Thaman et al. | |
| 5,221,288 | A | 6/1993 | Kamata et al. | |
| 5,376,699 | A | 12/1994 | Sage | |
| 5,389,093 | A | 2/1995 | Howell | |
| 5,606,983 | A * | 3/1997 | Monty et al. | 132/229 |
| 5,690,857 | A | 11/1997 | Osterried et al. | |
| 5,705,093 | A | 1/1998 | Coates et al. | |
| 5,829,157 | A | 11/1998 | Gittens et al. | |
| 6,270,783 | B1 | 8/2001 | Slavtcheff et al. | |
| 2002/0110583 | A1 * | 8/2002 | Grey | 424/443 |

FOREIGN PATENT DOCUMENTS

| | | |
|---|---|---|
| AU | 25423/77 | 5/1977 |
| DE | 298 08 279 | 5/1998 |
| FR | 2 726 164 | 10/1994 |
| WO | 90/02054 | 3/1990 |
| WO | 91/09106 | 6/1991 |

* cited by examiner

*Primary Examiner*—Carlos A. Azpuru
*Assistant Examiner*—David Vanik
(74) *Attorney, Agent, or Firm*—Karen E. Klumas

(57) ABSTRACT

A hair covering which comprises a woven or nonwoven substrate comprising synthetic or natural materials, which are impregnated, or coated, or both, with a mutable dye is described.

18 Claims, 1 Drawing Sheet

METHOD OF TREATING HAIR WITH HEAT AND A CAP WHICH PROVIDES A SIGNAL REGARDING TREATMENT

This is a Divisional of Ser. No. 09/952,061 filed Sep. 14, 2001 now abandoned.

BACKGROUND OF THE INVENTION

There are many hair treatment compositions, which are applied to hair, and afterwards partially left in, and then heat is applied to the hair in order to activate the hair treatment agent, then may either rinse out or leave in. These treatment agents can include gels, shampoos, conditioners, leave-in conditioners, pomades, straightening balms or balms, serums, tonics, straightening and smooth creams and lotions and balms, semi and permanent hair coloring dyes, and the like.

In the past, people who desired to treat their hair in this manner faced the following problems:

(i) they did not know if they had treated their hair for a sufficient amount of time;

(ii) they would not know whether they had treated all of their hair;

(iii) they were not holding their hair in place, during treatment;

(iv) without the use of a cap, hair treatment agents tended to drip off of the hair.

It is an object of the present invention to address these above-mentioned problems.

The following patent is related to the field of the invention.

U.S. Pat. No. 4,725,462 discloses a woven textile fabric having hidden indicia which appear when the textile fabric is subjected to temperatures above 108° F.

SUMMARY OF THE INVENTION

A hair covering which comprises a woven or nonwoven substrate comprising synthetic or natural materials, which are impregnated, or coated, or both, with a mutable dye is described.

DETAILED DESCRIPTION OF THE INVENTION

Figure 1:
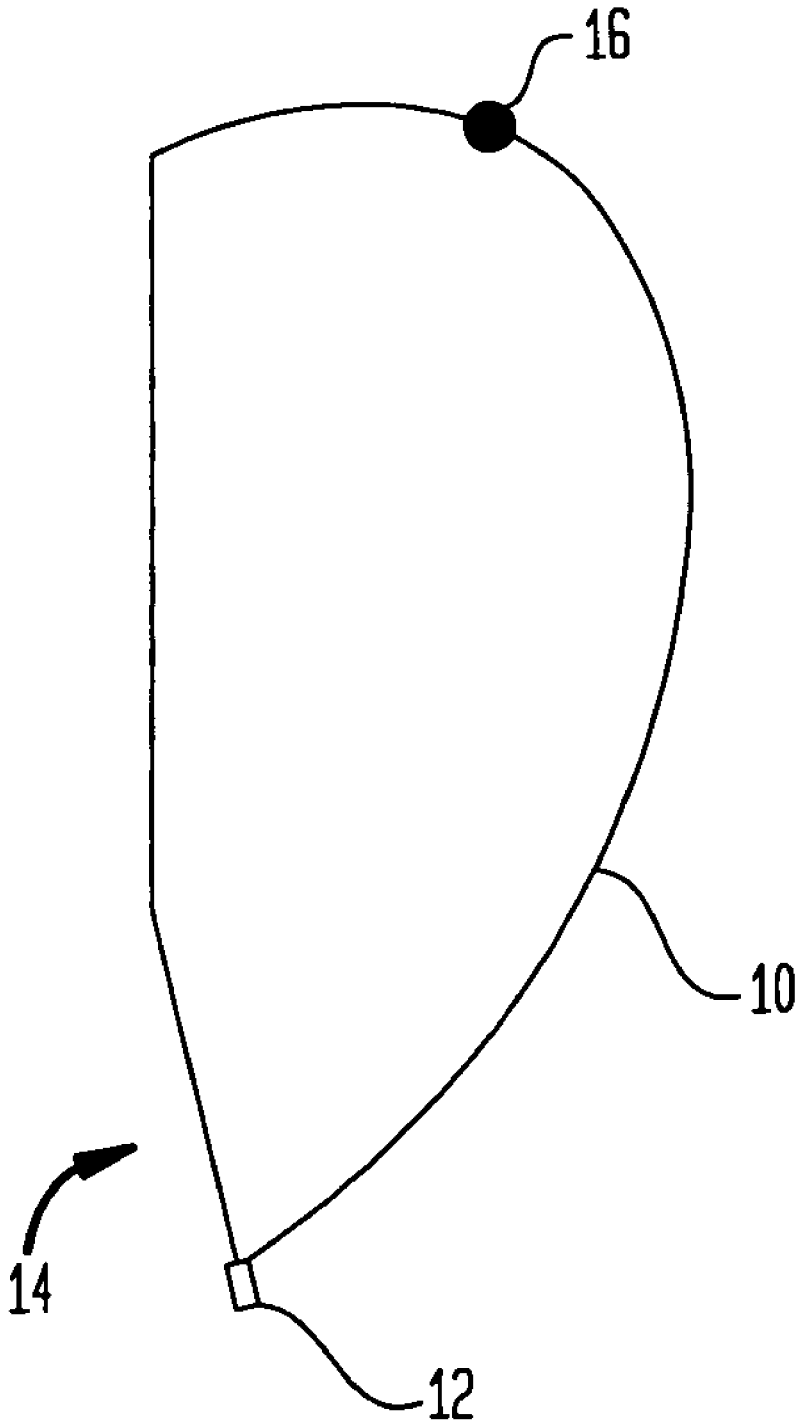
FIG. 1 is a cross section of an embodiment of a hair covering of the invention.

As used herein, %, means weight % of the total composition unless otherwise indicated. A woven substrate means a substrate that is formed by interlacing or intertwining strands or fibers.

A nonwoven substrate means its layer is comprised of fibers which are not woven into a fabric but rather are formed into a sheet, mat, or pad layer. These fibers can either be random (i.e., randomly aligned) or they can be carded (i.e., combed to be oriented in primarily one direction). Furthermore, the nonwoven substrate can be composed of a combination of layers of random and carded fibers.

A mutable dye means that it is capable of change, i.e., change from one color or another, or from colorless to color or vice versa. An example would be a thermally labile or thermally sensitive dye. Thermochromatic dyes are examples of a mutable dye. Thermochromatic dyes can include leukodyes. Thermochromatic dyes can include liquid crystals.

The invention relates to a hair covering which comprises a woven or nonwoven (substrate) comprising natural or synthetic materials, which is impregnated, or coated, or both, with a mutable dye.

The invention also relates to a process for heat treating hair, which comprises:

i) applying to said hair a hair treating agent which is activated by heat;

ii) covering the hair with a hair covering as described above; and iii) heating the hair covering until the mutable dye changes color so as to indicate that said hair has been adequately heat treated; and that the hair treating agent has been left in the hair a sufficient amount of time.

As noted above, a difficulty with applying to hair a heat sensitive treatment agent, lies in knowing when enough heat has been applied to the hair.

The present invention solves this problem by applying a hair covering which is impregnated or coated or both with a mutable dye. A heat sensitive hair treatment agent is applied to the hair, the hair is then covered with the hair covering. Heat from an appliance such as a blow drier is then applied to the hair covering. When the mutable dye in the hair covering changes color, this serves to signal that adequate heat has been applied to the hair, and the heat treatment of the hair has been completed.

There are many advantages to the present invention. In the first place, the hair covering serves to indicate when adequate heat has been applied. In addition, the hair covering serves to indicate that the hair treating agent has been applied for a sufficient amount of time. Also, the hair covering serves to hold the hair in place while heat is being applied. When heat is applied to uncovered hair with a blow drier, the hair tends to get blown around which can be messy. In addition, a hair covering can serve to prevent hair treatment agent from dripping during the treatment period. Moreover, depending on the material of the hair covering, it can serve to transmit heat uniformly from the hair covering to the hair. Also consumers enjoy the feeling of being pampered, which comes with wearing the nicely fitting, nicely colored, and well-textured hair coverings of the present invention.

Hair coverings of the present invention can be made by known methods or by methods which are analogous to those known in the art.

What follows is a description of the components that can go into the making of a hair covering of a composition of the invention.

Fabric or Substrate of the Hair Covering

Nonlimiting examples of suitable insoluble substrates which can be used in the present invention and which meet the above criteria include nonwoven substrates, woven substrates, hydroentangled substrates, air entangled substrates, natural sponges, synthetic sponges, polymeric netted meshes, and the like. Preferred embodiments employ nonwoven substrates since they are economical and readily available in a variety of materials. By nonwoven is meant that the layer is comprised of fibers which are not woven into a fabric but rather are formed into a sheet, mat, or pad layer. The fibers can either be random (i.e., randomly aligned) or they can be carded (i.e., combed to be oriented in primarily one direction). Furthermore, the nonwoven substrate can be composed of a combination of layers of random and carded fibers.

Nonwoven substrates may be comprised of a variety of materials both natural and synthetic. By natural is meant that the materials are derived from plants, animals, insects or by-products of plants, animals, and insects. By synthetic is meant that the materials are obtained primarily from various man-made materials or from natural materials which have been further altered. The conventional base starting material is usually a fibrous web comprising any of the common synthetic or natural textile-length fibers, or mixtures thereof.

Nonlimiting examples of natural materials useful in the present invention are silk fibers, keratin fibers and cellulosic fibers. Nonlimiting examples of keratin fibers include those selected from the group consisting of wool fibers, camel hair fibers, and the like. Nonlimiting examples of cellulosic fibers include those selected from the group consisting of wood pulp fibers, cotton fibers, hemp fibers, jute fibers, flax fibers, and mixtures thereof.

Nonlimiting examples of synthetic materials useful in the present invention include those selected from the group consisting of acetate fibers, acrylic fibers, cellulose ester fibers, methacrylic fibers, polyamide fibers, polyester fibers, polyolefin fibers, polyvinyl alcohol fibers, rayon fibers, polyurethane foam, and mixtures thereof. Examples of some of these synthetic materials include acrylics such as acrilan, creslan, and the acrylonitrile-based fiber, orlon; cellulose ester fibers such as cellulose acetate, arnel, and acele; polyamides such as nylons (e.g., nylon 6, nylon 66, nylon 610, and the like); polyesters such as fortel, kodel, and the polyethylene terephthalate fiber, dacron; polyolefins such as polypropylene, polyethylene; polyvinyl acetate fibers; polyurethane foams and mixtures thereof. These and other suitable fibers and the nonwoven materials prepared therefrom are generally described in Riedel, "Nonwoven Bonding Methods and Materials," *Nonwoven World* (1987); *The Encyclopedia Americana*, vol. 11, pp. 147–153, and vol. 26, pp. 566–581 (1984); U.S. Pat. No. 4,891,227 to Thaman et al., issued Jan. 2, 1990; and U.S. Pat. No. 4,891,227, to Thaman et al., issued Jan. 2, 1990; and U.S. Pat. No. 4,891,228 which are all incorporated by reference herein in their entirely.

Nonwoven substrates made from natural materials consist of webs or sheets most commonly formed on a fine wire screen from a liquid suspension of the fibers. See C. A. Hampel et al., *The Encyclopedia of Chemistry*, third edition, 1973, pp. 793–795 (1973); *The Encyclopedia Americana*, vol. 21, pp. 376–383 (1984); and G. A. Smook, *Hand of Pulp and Paper Technologies*, Technical Association for the Pulp and Paper Industry (1986); which are incorporated by reference herein in their entirely.

Substrates made from natural materials useful in the present invention can be obtained from a wide variety of commercial sources. Nonlimiting examples of suitable commercially available paper layers useful herein include Airtex®, an embossed airlaid cellulosic layer having a base weight of about 85 grams per square meter, available from James River, Green Bay, Wis.; and Walkisoft®, an embosssed airlaid cellulosic having a base weight of about 90 grams per square meter, available from Walkisoft U.S.A., Mount Holy, N.C.

Methods of making nonwoven substrates, including apertured red substrates, are well known in the art. Generally, these nonwoven substrates can be made by air-laying, water-laying, melt blowing, conforming, spin bonding, or carding processes in which the fibers or filaments are first cut to desired lengths from long strands, passed into a water or air stream, and then deposited onto a screen or belt through which the fiber-laden air or water is passed. The resulting layer, regardless of its method of production or composition, is then subjected to at least one of several types of bonding operations to anchor the individual fibers together to form a self-sustaining web. In the present invention the nonwoven layer can be prepared by a variety of processes including hydroentanglement, thermally bonding or thermo-bonding, and combinations of these processes. Moreover, the substrates used in the present invention can consist of a single layer or multiple layers. In addition, a multi-layered substrate can include films and other non-fibrous materials.

Moreover, substrates can also be made which use liquid crystal thermochromic substances on substrates. In this connection, attention is directed to U.S. Pat. Nos. 6,270,783; 5,705,093; and 5,690,857, all of which are hereby incorporated by reference. WO 91/09106 is also hereby incorporated by reference.

Hair coverings according to the present invention can allow connection of one portion of the fabric to another through a fastening device which may be selected from the group consisting of a button and hole, a button and loop, a hook and loop, a buckle and a snap button.

Hair Covering

A hair covering, as shown in FIG. 1, has an upper edge, 10, which leads to a string for tying, 12, which leads to a bottom edge, 14, which forms the opening for the head. The upper edge, 14, also has a button, 16, for securing the hair covering to the head.

Mutable Dyes

Thermochromic Material

The thermochromic material which can be used in the present invention includes, among others, a variety of known thermochromic materials each containing an acid responsive chromogenic substance and an acidic substance.

The acid-responsive chromogenic substance in said thermochromic material includes triphenylmethanephthalide compounds, phthalide compounds, phthalan compounds, acyl-leucomethylene blue compounds fluoran compounds, triphenylmethane compounds, diphenylmethane compounds, spiropyran compounds and so on. Among species of such compounds are 3,6-dimethoxyfluroran, 3,6-dibutoxyfluoran, 3-diethylamino 6,8-dimethylfluoran, 3-chloro-6-phynylaminofluoran, 3-diethylamino-6-methyl-7-chlorofluoran, 3-diethylamino 7,8-benzofluroran, 2-anlino-3-methyl-6-diethylamino fluoran, 3,3',3"-tris(p-dimethylaminophenyl)phthalide, 3,3'-bis(p-dimethylaminophenyl)phthalide, 3-diethylamino-7-phenylaminofluoran, 3,3-bis(p-diethylaminophynel-6-dimethylaminophthalide, 3-(4-diethylaminophenyl)-3-(1-ethyl-2-methylindol-3-yl)phthalide, 3-(4-diethylamino-2-mehtyl)phenyl-3-(1,2-dimethylindol-3-yl)phthalide, 2'-(2-chloroanilino)-6'dibutylaminospiro-[phthalido-39'-xanthenel] and so on.

The acidic substance mentioned above includes, 1,2,3-benzotriazole compounds, phenol compounds, thiourea compounds, oxo-aromatic carboxylic acids and soon. Among specific examples of such compounds are 5-butylbenzotriazole, bisbenzotriazole-5-methane, phenol, nonylphenol, bisphenol A, bisphenol F, 2,2'-biphenol, β-naphthol, 1,5-dihydroxynaphthalene, alkyl p-hydroxybenzoates, phenol resin oligomer and so on.

The amount of the acidic substance may be in the range of about 0.1 to 50 parts by weight per part by weight of the acid-responsive chromogenic substance.

Any of the thermochromic materials each containing an acid-responsive chromogenic substance and an acidic substance is preferably used as diluted with a solvent beforehand. The use of a solvent renders the material responsive to change in temperature with greater sensitivity and definition. The solvent which can be used for the thermochromic material includes, among others, alcohols, alcohol-acrylonitrile adducts, azomethine compounds, esters and so on. Among specific examples of the solvent are decyl alcohol, lauryl alcohol, myristyl alcohol, cetyl alcohol, stearyl alcohol, behenyl alcohol, lauryl alcohol-acrylonitrile adduct, myristyl alcohol-acrylonitrile adduct, a steryl alcohol acylonitrile adduct, benzylidene-p-toluidine, benzylidene-butylamine, octyl caprate, decyl caprate, myristyl caprylate, decyl laurate, lauryl laurate, myristyl laurate, decyl myristate, lauryl myristate, cetyl myristate, lauryl palmitate, cetyl palmitate, stearyl palmitate, cetyl p-t-butyl benzoate, stearyl 4-methoxybenzoate, dilauryl thiodipropionate, dimyristyl thiodipropionate, stearyl benzoate, benzyl starat, dibenzyl thiodipropionate, distearyl thiodipropionate, benzyl benzoate, glycerol trilaurate and so on.

The amount of the solvent may be in the range of 0 to 800 parts by weight, preferably 0.1 to 100 parts by weight, per part by weight of the acid-responsive chromogenic substance.

Nonlimiting examples of thermochromatic dyes also can include Michler's hydrol, Crystal Violet carbinol, Malachite Green carbinol, N-(2,3-dichlorophenyl)-leuco auramine, N-benzoyl auramine, N-acetyl auramine, N-phenyl auramine, Rhodamine B lactam, 2-(phenyliminoethylidene)-3,3-dimethyl-indoline, N,3,3-trimethyl-indolinobenzo-spiropyran, 8'-methoxy-N,3,3-trimethylindolino-spiropyran, 3-diethylamino-6-methyl-7-chloro-fluoran, 3-diethylamino-7-methoxy-fluoran, 3-dimethylamino-6-benzyloxy-fluoran, 1,2-benzo-6-diethylaminofluoran, 3,6-di-p-toluidino-4,5-dimethylfluoran-phenylhydrazide-gamma.-lactam, 3-amino-5-phenyl-8-methyl-fluoran, 2-methyl-3-amino-6-methyl-7-methyl-fluoran, 2,3-butylene-6-di-n-butylamino-fluoran, 3-diethylamino-7-anilino-fluoran, 3-diethylamino-7-(p-toluidino)-fluoran, 7-acetamino-3-diethylamino-fluoran, 2-bromo-6-cyclohexylamino-fluoran, 2,7-dichloro-3-methyl-6-n-butylamino-fluoran and the like.

Other examples of thermochromatic dyes suitable for use herein are leuco dyes selected from the group consisting of: 1,3,3-trimethylspiro[indoline-2,3'-(3H)naphtho(2,1-b)(1,4)-oxazine]; 6'-indolino-1,3,3-trimethylspiro[indoline-2,3'-(3H)naphtho(2,1-b)(1,4)-oxazine]; 5-chloro-1,3,3-trimethylspiro[indoline-2,3'-(3H)naphtho(2,1-b)(1,4)-oxazine]; 6'-piperidino-1,3,3-trimethylspiro[indoline-2,3'-(3H)naphtho(2,1-b)(1,4)-oxazine]; benzyl-3,3-dimethylspiro[indoline-2,3'-(3H)naphtho(2,1-b)(1,4)-oxazine]; 1,3,5,6-tetramethyl-3-ethylspiro[indoline-2,3'-(3H)naphtho(2,1-b)(1,4)-oxazine]; 1,3,3,5,6-pentamethylspiro[indoline-2,3'-(3H)naphtho(2,1-b)(1,4)-oxazine]; 1,3,5,6-tetramethyl-3-ethylspiro[indoline-2,3'-(3H)pyrido(3,2-f)(1,4)-benzoxazine]; 1,3',3'-trimethylspiro(2H-2-benzopyran-2,2'-indoline); 1,3,3-triphenylspiro[indoline 2,3'-(3H)naphtho(2,1-b)pyran]; 1-(2,3,4,5,6-pentamethylbenzyl)-3,3-dimethylspiro[indoline-2,3'-(3H)naphtho(2,1-b)pyran]; 1-(2-nitrobenzyl)-3,3-dimethylspiro[indoline-2,3'-(3H)naphtho(2,1-b)pyran]; 2,2-diphenylnaphtho(2,1-b)pyran; 2,2-di(p-methoxyphenyl)naphtho(2,1-b)pyran; 2,5 dimethylfuryltrimethylfulgide; 2-methyl-5-chlorotrimethylfulgide; spiro[2H-chromen-2,2'-tricyclo[3.3.1.1.sup.3.7]decane; spiro[2H-naphtho[1,2-b]pyran-2,2'-tricyclo[3.3.1.1.sup.3.7]decane]; 5,7-dimethylspiro[2H-chromene-2,2'tricyclo[3.3.1.1.sup.3.7]decane]; 6-(4-methoxyphenyl)-9-methoxyspiro[2H naphtho[1,2-b]pyran-2,2'-tricyclo][3.3.1.1.sup.3.7]decane]; 6-chlorospiro[2H-naptho[1,2-b]pyran-2,2'-tricyclo[3.3.1.1.sup.3.7]decane and mixtures thereof.

Nonlimiting examples of thermochromatic dyes can also include from about 1% to about 20% by weight of one or more electron-donating, chromatic organic compounds selected from the group consisting of diaryl phthalides, polyaryl carbinols, leuco auramines, lactum leuco compounds, indolines, spiropyrans and fluoranes, and one or more electron-donating chromatic organic compounds selected from the group consisting of diaryl phthalides, indolyl phthalides, polyaryl carbinols, leuco auramines, acyl auramines, aryl auramines, Rhodamine B lactam, indolines, spiropyrans and fluorans, and one or more electron-donating, chromatic organic compounds selected from the group consisting of diaryl phthalides, aryl phthalides, indolylphthalides, polyarylcarbinols, leucoauramines, acrylauramines, arylauramines, rhodamine B lactams, indolines, spiropyrans, fluorans, thiofluorans, phenothiazines, triphenylmethanes, diarylarylfurans, spiroxanthenearylfurans, and chromenoindoles.

Nonlimiting examples of thermochromatic dyes also can include electron-donating, chromatic organic compounds such as 3-amino-5-methylfluoran, 3-diethylamino-6-methyl-7-dimethylamino-thiofluoran, 3-diethylamino-7-dibenzylamino-thiofluoran, 3,3-bis(1-ethyl-2-methyl-3-yl)phthalide, 3,3-bis(2-phenylindol-3-yl)phthalide, 3-(4-diethylaminophenyl)-3-(1-ethyl-2-methylindol-3-yl) phthalide, 3-(4-di-n-butylaminophenyl)-3-(2-phenylindol-3-yl)phthalide, 3-(duroridine-6'-yl)-3-(1'-methyl-2'-phenylindol-3'-yl)phthalide, 3-(1',2',3',4'-tetrahydroquinolin-6'-yl)3-(1'-ethyl-2'-methyl-indol-3'-yl) phthalide, 3,3-bis(1-ethyl-2-methyl-indol-3-yl)-7-azaphthalide, 3-(diphenylamino)-3-(1-ethyl-2-methylindol-3-yl)phthalide, 3-[N-(4-ethoxyphenyl)N-phenylamino]-3-(1-ethyl-2-methylindol-3-yl)phthalide, 3-[4-(dimethylamino)phenyl]-3-[N,N-bis-(4-octylphenyl)amino] phthalide, 3-[4-(ethylbenzylamino)phenyl]-3-[N-(4-ethoxyphenyl)N-phenylamino]phthalide, 2,2-bis(p-N,N-dimethylaminophenyl)2-H-naphtho[1,8-bc]furan, spiro-3,6-bis(dimethylamino)xanthen-9,2-(2H)-naphtho[1,8-bc]furan, 6,6-bis(4-dimethylaminophenyl)-6H-chromeno[4,3-b]indole and the like.

These dyes are described in U.S. Pat. Nos. 4,028,118, 4,421,560; and 4,421,561, all of which are hereby incorporated by reference.

Thermochromatic dyes which can be used in the present invention also include liquid crystals which can be spray-coated onto a substrate such as are described in U.S. Pat. No. 5,376,699 which is hereby incorporated by reference.

The preferred thermochromic substances to be used in the present invention include chiral nematic liquid crystals, cholesteric liquid crystals and smectic liquid crystals. Preferably, microencapsulated chiral nematic liquid crystals suspended in aqueous medium are used in the invention. Various types of suitable thermochromic substances are disclosed in UK Patent Specification Nos. 1556994, 1592161, 1596012, 1596013, 1596014 and 1603076.

The thermochromic substances used in the present invention preferably exhibit several color changes over a range of temperatures, typically −30–150 degrees Celsius, preferably 0–50 degrees Celsius, and especially temperatures such as produced by contact with the body. The thermochromic substances may be colorless or black and typical color changes may be from colorless or black to tan to red to green to blue. Two or more thermochromic substances may be used which change color at different temperatures so that a mixture of color changes may be produced.

The method of the invention may be used on individual fibers, fabrics prior to making up into a garment or cap or hair covering. Preferred fibers and fabrics will be black, although other dark colored substrates have also been found to be suitable. Paler colored substrates may also be used by first overprinting with a darker, preferably black layer. They may also advantageously be fine, thin or supple. Suitable fabrics include cotton, polyester, silks and chiffons.

The compositions used in the invention may be applied to fibers and fabrics in any suitable way, such as by printing, including screen printing, spraying, dipping, brushing, laminating, doctor bar, wire wound bar and electrostatic pressing. See, e.g., WO 90/02054.

EXAMPLE

A surface coating medium is made containing, 30 parts by weight of an encapsulated thermochromic liquid crystal dispersion Licritherm. RTM. TCC-1001 (commercially available from Merck Ltd., Poole/UK), 5 parts by weight of an acrylic polymer HV30.RTM. (commercially available from Allied Colloids Ltd.), 30 parts by weight of a fusible polyamide powder Griltex 5.RTM. (P1) (commercially available from EMS-Grilon UK, Ltd.), 5 parts by weight of an ammonia solution (10% aqueous solution) and 30 parts by weight of water.

The medium is printed onto a woven black polyester/cotton fabric by screen printing (180 threads per inch) and air-dried at 50.degree. C. for 10 minutes.

It should be understood that the term 'thermochromic material' is used herein to mean any and all thermochromic materials inclusive of pseudo-thermochromic materials which show a hysteresis of thermochronism. Thermochromatic dyes can include leukodyes.

In accordance with the present invention, the hair covering may only partially cover the hair, hereby allowing some of the hair to be heat treated while the rest is not.

The hair treatment methods of the invention may be carried out in conjunction with other treatments such as hair cutting and hair coloring.

The mutable dye may be impregnated or coated onto the covering in the form of a design, a logo, or an insignia.

The mutable dye may blend with other permanent or non-mutable dyes so as to cause a color change. For example, the hair covering may have on it a permanent dye which is blue and a mutable dye which is yellow. Together, these dyes form the color green. When heat is applied to the hair covering, the mutable dye which is yellow, may disappear in color, thereby leaving the color blue.

The hair covering of the invention may contain two or more mutable dyes, one which changes color at a threshold temperature, and the second, which changes color at a still higher temperature. Color change by the first dye may indicate that a desired threshold temperature has been reached. Color change by the second dye may indicate that the hair has been brought to too high a temperature.

Hair treatment compositions which may be employed in the methods of the invention can include gels, shampoos, conditioners, leave-in conditioners, pomades, straightening balms, serums, tonics, creams, lotions, dye semi-permanent dyes and the like.

Nonwoven material which may be included in the hair coverings of the invention may include polypropylene. Polypropylene fabrics which may be included in the hair coverings of the present invention can range in weight from about ½ OSY to about 5 OSY.

The Tg of the polymer employed in a hair covering of the invention will usually exceed the activation temperature of the thermochromatic dye in the hair covering. The usual temperature range that hair experiences during blow drier using is about 49° C.+/−5–6° C. However, the Tg of the polymer can be slightly higher or significantly exceed the activation temperature of the thermochromatic dye and such Tg can range from about 55° C. to greater than 300° C.

The following are examples of hair treatment agents, and more specifically hair conditioning agents, which may be employed in the methods of the present invention. These examples are meant to illustrate but not limit the invention.

| | Percent Raw Material in Formula | | | |
|---|---|---|---|---|
| Ingredients | A | B | C | D |
| PEG-2 Oleammonium Cloride, 69% active and Propylene Glycol, 31 active %[1] | 2.00 | 2.00 | 2.00 | — |
| Quaternium-18, 75% active and Propylene Glycol, 25% active[2] | — | — | — | 0.73 |
| Behentrimonium Chloride, 85% active and Isopropyl Alcohol, 15% active[3] | — | — | — | 1.40 |
| Stearamidopropyldimethylamine, 100% active[4] | — | 0.75 | 0.75 | — |
| Behenetrimonium Methosulfate, 25% active and Cetearyl Alcohol, 100% active[5] | — | 1.00 | 1.00 | — |
| Cetearyl Alcohol, 100% | 8.25 | 10.00 | 8 00 | 4.00 |
| Dimethiconol, 36.5% active and TEA-Dodecylbenzenesulfonate, 4.5% active[6] | 2.00 | 2.00 | 2.00 | 1.60 |
| Cyclopentasiloxane, 99% active[7] | 2.00 | 2.00 | 2.00 | 2.00 |
| Other[8] | Q.S. | Q.S. | Q.S. | Q.S. |

[1]Ethoquad 0-12PG from Akzo Nobel Chemicals Mc Cook, Illinois
[2]Arquad 2HT-75 PG from Akzo Nobel Chemicals Mc Cook, Illinois
[3]Incroquat TMC-85 from Croda Inc. Mill Hall, Pennsylvania
[4]Lexamine S-13 from Inolex Chemical Company Philadelphia, Pennsylvania
[5]Incroquat Behenyl TMS from Croda Inc. Mill Hall, Pennsylvania
[6]DC 2-1786 from Dow Corning Corporation Midland, Michigan
[7]Silicone 245 from Dow Corning Corporation Midland, Michigan
[8]water, fragrance, preservatives, pH adjusters and other minor ingredients.

Examples A, B, C and D are prepared by methods which are known in the art.

While the invention has been described in complete detail and pictorially shown in the accompanying drawings, it is not to be limited to such details, since many changes and modifications may be made in the invention without departing from the spirit and the scope thereof. Hence, the invention is intended to cover any and all modifications and forms which may come within the language and scope of the claims.

The invention claimed is:

1. A method for treating hair which comprises:

i) contacting said hair with a hair treatment agent which is activated by heat;

ii) covering said hair or a part of said hair with a hair covering which comprises a woven or non-woven fabric impregnated, coated or both impregnated and coated with at least one mutable dye;

iii) applying heat to said hair covering; and iv) causing the hair covering to change color indicating that said hair treatment agent in said hair has been activated by said heat.

2. A method according to claim 1, wherein said hair treatment agent is a hair conditioner, said contacting step imparting conditioning to said hair.

3. A method according to claim 1, wherein said hair treatment agent is selected from the group consisting of a gel, a shampoo, a rise-out conditioner, a leave-in conditioner, a straightening product, a smoothing product, a serum, a pommade, a semi-permanent dye, and a permanent dye.

4. A method according to claim 1, which comprises at least two mutable dyes, wherein one dye changes color at a first temperature, and wherein a second dye changes color at a second temperature different from said first temperature.

5. A method according to claim 1, wherein said mutable dye is impregnated in said fabric in a design, a logo or an insignia.

6. A method according to claim 1, wherein said fabric has a Tg which is substantially higher than any temperature transferable by a hair blow dryer appliance.

7. A method according to claim 1, wherein said mutable dye is a leuco dye.

8. A method according to claim 7, wherein said mutable dye is selected from the group consisting of: 1,3,3-trimethylspiro[indoline-2,3'-(3H)naphtho(2,1-b)(1,4)-oxazine]; 6'-indolino-1,3,3-trimethylspiro[indoline-2,3'-(3H)naphtho(2,1-b)(1,4)-oxazine]; 5-chloro-1,3,3-trimethylspiro[indoline-2,3'-(3H)naphtho(2,1-b)(1,4)-oxazine]; 6'-piperidino-1,3,3-trimethylspiro[indoline-2,3'-(3H)naphtho(2,1-b)(1,4)-oxazine]; benzyl-3,3-dimethylspiro[indoline-2,3'-(3H)naphtho(2,1-b)(1,4)-oxazine]; 1,3,5,6-tetramethyl-3-ethylspiro[indoline-2,3'-(3H)naphtho(2,1-b)(1,4)-oxazine]; 1,3,3,5,6-pentamethylspiro[indoline-2,3'-(3H)naphtho(2,1-b)(1,4)-oxazine]; 1,3,5,6-tetramethyl-3-ethylspiro[indoline-2,3'-(3H)pyrido(3,2-f)(1,4)-benzoxazine]; 1,3',3'-trimethylspiro(2H-2-benzopyran-2,2'-indoline); 1,3,3-triphenylspiro[indoline 2,3'-(3H)naphtho(2,1-b)pyran]; 1-(2,3,4,5,6-pentamethylbenzyl)-3,3-dimethylspiro[indoline-2,3'-(3H)naphtho(2,1-b)pyran]; 1-(2-nitrobenzyl)-3,3-dimethylspiro[indoline-2,3'-(3H)naphtho(2,1-b)pyran]; 2,2-diphenylnaphtho(2,1-b)pyran; 2,2-di(p-methoxyphenyl)naphtho(2,1-b)pyran; 2,5 dimethylfuryltrimethylfulgide; 2-methyl-5-chlorotrimethylfulgide; spiro[2H-chromen-2,2'-tricyclo[3.3.1.1.sup.3.7]decane; spiro[2H-naphtho[1,2-b]pyran-2,2'-tricyclo[3.3.1.1.sup.3.7]decane]; 5,7-dimethylspiro[2H-chromene-2,2'tricyclo[3.3.1.1.sup.3.7]decane]; 6-(4-methoxyphenyl)-9-methoxyspiro[2H naphtho[1,2-b]pyran-2,2'-tricyclo][3.3.1.1.sup.3.7]decane]; 6-chlorospiro[2H-naptho[1,2-b]pyran-2,2'-tricyclo[3.3.1.1.sup.3.7]decane and mixtures thereof.

9. A method according to claim 1, wherein the hair covering comprises at least one mutable dye and at least one non-mutable dye.

10. A method according to claim 1, wherein a fragrance is embedded into said fabric.

11. A method according to claim 1, wherein said mutable dye is thermochromatic.

12. A method according to claim 11, wherein said mutable dye is selected from the group consisting of: 3,3;-dimethoxyfluoran (yellow); 3-chloro-6-phenylaminofluoran (orange); 3-diethylamino-6-methyl-7-chlorofluoran (vermilion); 3-diethyl-7,8-benzofluoran (pink); Crystal Violet lactone (blue); 3,3',3"-tris(p-dimethylaminophenyl)phthalide (purplish blue); Malachite Green lactone (green); 3,3'-bis-(p-dimethylaminophenyl)phthalide (green); 3-diethylamino-6-methyl-7-phenylaminofluoran (black); indolyl phthalides; spiropyrans; coumarins; 3,6-dimethoxyfluoran; 3,6-dibutoxyfluoran; 3-diethylamino-6,8-dimethylfluoran; 3-chloro-6-phenylaminofluoran; 3-diethylamino-6-methyl-7-chlorofluoran; 3-diethylamino 7,8-benzofluoran; 2-anilino-3-methyl-6-diethylaminofluoran; 3,3',3"-tris(p-dimethylaminophenyl)phthalide; 3,3'-bis(p-dimethylaminophenyl)phthalide; 3-diethylamino-7-phenylaminofluoran; 3,3-bis(p-diethylaminophenyl)-6-dimethylaminophthalide; 3-(4-diethylaminophenyl)-3-(1-ethyl-2-methylindol-3-yl)phthalide; 3-(4-diethylamino-2-methyl)phenyl-3-(1,2-dimethylindol-3-yl)phthalide; 2'-(2-chloroanilino)-6'-dibutylaminospiro-[phthalido-3,9'-xanthene] and mixtures thereof.

13. A method according to claim 1 wherein said fabric comprises a material selected from the group consisting of woven substrates, nonwoven substrates, hydroentangled substrates, air entangled substrates, natural sponges, synthetic sponges, and polymeric netted sponges and mixtures thereof.

14. A method according to claim 1 wherein said fabric comprises a material selected from the group consisting of silk fiber, wool fiber, camel hair, wood pulp fiber, cotton fiber, hemp fiber, jute fiber, flax fiber, and mixtures thereof.

15. A method according to claim 1, wherein said fabric comprises a material selected from the group consisting of cellulose; polyamides; polyesters; polypropylene; polyethylene; polyvinyl acetate; polyurethane and mixtures thereof.

16. A method according to claim 1, wherein said fabric is water-insoluble.

17. A method according to claim 1, wherein one portion of said fabric is fastened to another portion of said fabric through use of a device selected from the group consisting of a button and hole, a button and loop, a hook and loop, a buckle, and a snap button.

18. A method for treating hair which comprises:

1. contacting said hair with a hair treatment agent;
2. covering said hair or a part of said hair with a hair covering which comprises a woven or non-woven fabric impregnated, coated or both impregnated and coated with at least one mutable dye;
3. applying heat to said hair covering whereby said hair covering changes color indicating that said hair treatment has been left on the hair a sufficient amount of time.

* * * * *